US007854105B2

(12) United States Patent
Zitella et al.

(10) Patent No.: US 7,854,105 B2
(45) Date of Patent: Dec. 21, 2010

(54) FILM WRAPPING MACHINE UTILIZING TWO FILM CARRIAGE ASSEMBLIES TO EFFECTIVELY PERFORM FILM CHANGE OPERATIONS

(75) Inventors: Marco Zitella, Montreal (CA); Faruk Turfan, Brossard (CA)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 12/461,754

(22) Filed: Aug. 24, 2009

(65) Prior Publication Data

US 2010/0000184 A1 Jan. 7, 2010

Related U.S. Application Data

(63) Continuation of application No. 11/723,221, filed on Mar. 19, 2007, now abandoned.

(51) Int. Cl.
*B65B 13/14* (2006.01)

(52) U.S. Cl. ..... 53/441; 53/399; 53/556; 53/588; 53/589

(58) Field of Classification Search ..... 53/397, 53/399, 441, 556, 580, 582, 588–589
See application file for complete search history.

(56) References Cited

U.S. PATENT DOCUMENTS

| | | | | |
|---|---|---|---|---|
| 4,503,658 | A | 3/1985 | Mouser et al. | |
| 4,587,796 | A | 5/1986 | Haloila | |
| 4,628,668 | A | 12/1986 | Wildmoser | |
| 4,676,048 | A | 6/1987 | Lancaster et al. | |
| 4,712,354 | A | 12/1987 | Lancaster et al. | |
| 4,862,678 | A | 9/1989 | Humphrey | |
| 4,905,448 | A | 3/1990 | Plitt | |
| 4,905,451 | A | 3/1990 | Jaconelli et al. | |
| 5,182,894 | A | 2/1993 | Bate | |
| 5,311,725 | A | 5/1994 | Martin et al. | |
| 5,517,807 | A | 5/1996 | Morantz | |
| 5,531,061 | A | 7/1996 | Peterson | |
| 5,755,083 | A * | 5/1998 | Cleine | 53/588 |
| 5,766,773 | A | 6/1998 | Paulett et al. | |
| 5,787,691 | A | 8/1998 | Turfan | |
| 6,195,961 | B1 | 3/2001 | Turfan | |
| 6,269,610 | B1 | 8/2001 | Lancaster et al. | |

(Continued)

FOREIGN PATENT DOCUMENTS

| | | |
|---|---|---|
| EP | 1332968 | 8/2003 |

(Continued)

*Primary Examiner*—Christopher Harmon
(74) *Attorney, Agent, or Firm*—Law Offices of Steven W. Weinrieb

(57) ABSTRACT

A film wrapping machine comprises a pair of diametrically opposed film roll mounting and dispensing carriage assemblies which are used to individually and sequentially dispense their wrapping films. Accordingly, if depletion or breakage occurs within the wrapping film being dispensed by a first one of the pair of film roll mounting and dispensing carriage assemblies, the second film roll mounting and dispensing carriage assembly can effectively be activated so as to dispense its wrapping film whereby the film wrapping operation can continue with a minimum amount of stoppage or downtime. The switch-over or change-over between the first and second film roll mounting and dispensing carriage assemblies can be achieved in accordance with automatic and semi-automatic modes of operation.

20 Claims, 9 Drawing Sheets

U.S. PATENT DOCUMENTS

| | | | |
|---|---|---|---|
| 6,474,051 | B1 | 11/2002 | Hannen et al. |
| 6,598,379 | B2 | 7/2003 | Zitella et al. |
| 6,604,339 | B2 | 8/2003 | Zitella et al. |
| 6,745,544 | B2 | 6/2004 | Matsumoto et al. |
| 6,925,778 | B2 | 8/2005 | Suolahti |
| 6,945,018 | B2 | 9/2005 | Suolahti |
| 7,036,289 | B2 | 5/2006 | Suolahti |
| 7,111,439 | B2 | 9/2006 | Suolahti |

FOREIGN PATENT DOCUMENTS

| | | |
|---|---|---|
| FR | 2842503 | 1/2004 |
| FR | 2872486 | 1/2006 |
| WO | WO 00/53497 | 9/2000 |

* cited by examiner

FILM WRAPPING MACHINE UTILIZING TWO FILM CARRIAGE ASSEMBLIES TO EFFECTIVELY PERFORM FILM CHANGE OPERATIONS

This patent application is a Continuation patent application of prior U.S. patent application Ser. No. 11/723,221, which was filed on Mar. 19, 2007 now abandoned.

FIELD OF THE INVENTION

The present invention relates generally to film wrapping or packaging machines for wrapping film around articles, packages, or palletized loads, and more particularly to a new and improved film wrapping or packaging machine that has a pair of diametrically opposed film roll mounting and dispensing carriage assemblies disposed upon the rotary ring member of the film wrapping machine, which rotates around an article, package, or palletized load disposed at a wrapping or packaging station and which is being wrapped within the film wrapping or packaging material, wherein a first one of the diametrically opposed film roll mounting and dispensing carriage assemblies will dispense the wrapping or packaging film to be wrapped around the article, package, or palletized load disposed at the wrapping station, however, should the roll of film, disposed upon the first one of the film roll mounting and dispensing carriage assemblies, experience depletion in its film supply, or a breakage in its wrapping or packaging film, the second one of the film roll mounting and dispensing carriage assemblies will effectively be activated so as to dispense its film therefrom in order to complete the article, package, or palletized load wrapping or packaging operation.

BACKGROUND OF THE INVENTION

Film wrapping or packaging machines or apparatus, for wrapping articles, packages, or palletized loads within wrapping film, are of course well known in the art. Examples of such film wrapping machines or apparatus are disclosed within U.S. Pat. No. 6,195,961 which issued to Turfan on Mar. 6, 2001, U.S. Pat. No. 5,787,691 which issued to Turfan on Aug. 4, 1998, U.S. Pat. No. 5,517,807 which issued to Morantz on May 21, 1996, and U.S. Pat. No. 4,587,796 which issued to Haloila on May 13, 1986. As disclosed within FIG. 1, which substantially corresponds to FIG. 1 of the aforenoted U.S. Pat. No. 6,195,961 of Turfan, and which is representative of the conventional film wrapping or packaging machines, a film wrapping or packaging machine is generally indicated by the reference character 10 and is seen to comprise a four-post upstanding framework 12 through which extends a conveyor 14 for conveying articles, packages, or palletized loads, to be wrapped or packaged, to a wrapping station 16 which is located substantially at the center of the region or area which is peripherally defined by means of the four upstanding posts of the framework 12. An upper frame member 18, which is vertically movable in a reciprocating manner with respect to the framework 12, rotatably supports a ring or circular track member 20 upon which is mounted a plastic film roll mounting and dispensing assembly or carriage 22 upon which, in turn, is mounted a roll 24 of plastic wrapping film. Consequently, when the upper frame member 18 is moved in vertically upward and downward directions, and the ring or track member 20 is rotated with respect to the vertically movable upper frame member 18, film from the film roll 24, mounted upon the film roll mounting and dispensing assembly or carriage 22, can be withdrawn therefrom and applied onto the articles, packages, or palletized loads which are to be wrapped within film packaging material and which are disposed or located at the wrapping station 16.

It can of course be appreciated that after a plurality of articles, packages, or palletized loads have been wrapped within the film packaging or wrapping material disposed upon and withdrawn from the film roll 24, the film roll 24 will eventually become depleted and must therefore be replaced by means of a fresh roll of wrapping or packaging film. Alternatively, during a film wrapping operation, the packaging or wrapping film may in fact experience breakage. In either instance, therefore, the film roll 24, disposed upon the film roll mounting and dispensing assembly or carriage 22, must conventionally be replaced with a fresh and intact roll of wrapping or packaging film. While such an exchange or replacement procedure may of course be performed manually, such a procedure is tedious and time-consuming. More particularly, the wrapping operation must be temporarily halted or terminated, the upper frame member 18, upon which the ring or track member 20 and the film roll mounting and dispensing assembly or carriage 22 are mounted, must be vertically moved to an elevation at which the operator personnel can access the film roll 24 disposed upon the film roll mounting and dispensing assembly or carriage 22, the depleted roll of packaging or wrapping film, or the roll of packaging or wrapping film that experienced the break in the film, must then be removed from the film roll mounting and dispensing assembly or carriage 22, and a new or fresh roll of wrapping or packaging film 24 must be mounted upon the film roll mounting and dispensing assembly or carriage 22.

A need therefore exists in the art for a new and improved film wrapping or packaging machine which can automatically, or substantially automatically, accommodate the depletion or breakage of the film disposed upon the roll of wrapping or packaging film, by effectively continuing the article, package, or palletized load wrapping or packaging operation. In this manner, the article, package, or palletized load wrapping or packaging operation can effectively be completed with a minimum amount of operational downtime.

SUMMARY OF THE INVENTION

The foregoing and other objectives are achieved in accordance with the teachings and principles of the present invention through the provision of a new and improved film wrapping or packaging machine which has a pair of diametrically opposed film roll mounting and dispensing carriage assemblies disposed upon the rotary ring member of the film wrapping machine that rotates around the article, package, or palletized load which is disposed at the wrapping or packaging station and which is being wrapped within the film wrapping or packaging material, although only one of the diametrically opposed film roll mounting and dispensing carriage assemblies initially dispenses its wrapping or packaging film to be wrapped around the article, package, or palletized load disposed at the wrapping or packaging station. However, if film depletion or a breakage in the wrapping or packaging film occurs in connection with the film disposed upon the one of the film roll mounting and dispensing carriage assemblies initially dispensing the wrapping or packaging film, the other one of the film roll mounting and dispensing carriage assemblies will effectively be activated so as to continue the article, package, or palletized load wrapping or packaging operation.

BRIEF DESCRIPTION OF THE DRAWINGS

Various other features and attendant advantages of the present invention will be more fully appreciated from the following detailed description when considered in connection with the accompanying drawings in which like reference characters designate like or corresponding parts throughout the several views, and wherein.

DETAILED DESCRIPTION OF THE PREFERRED EMBODIMENT

Figure 1:
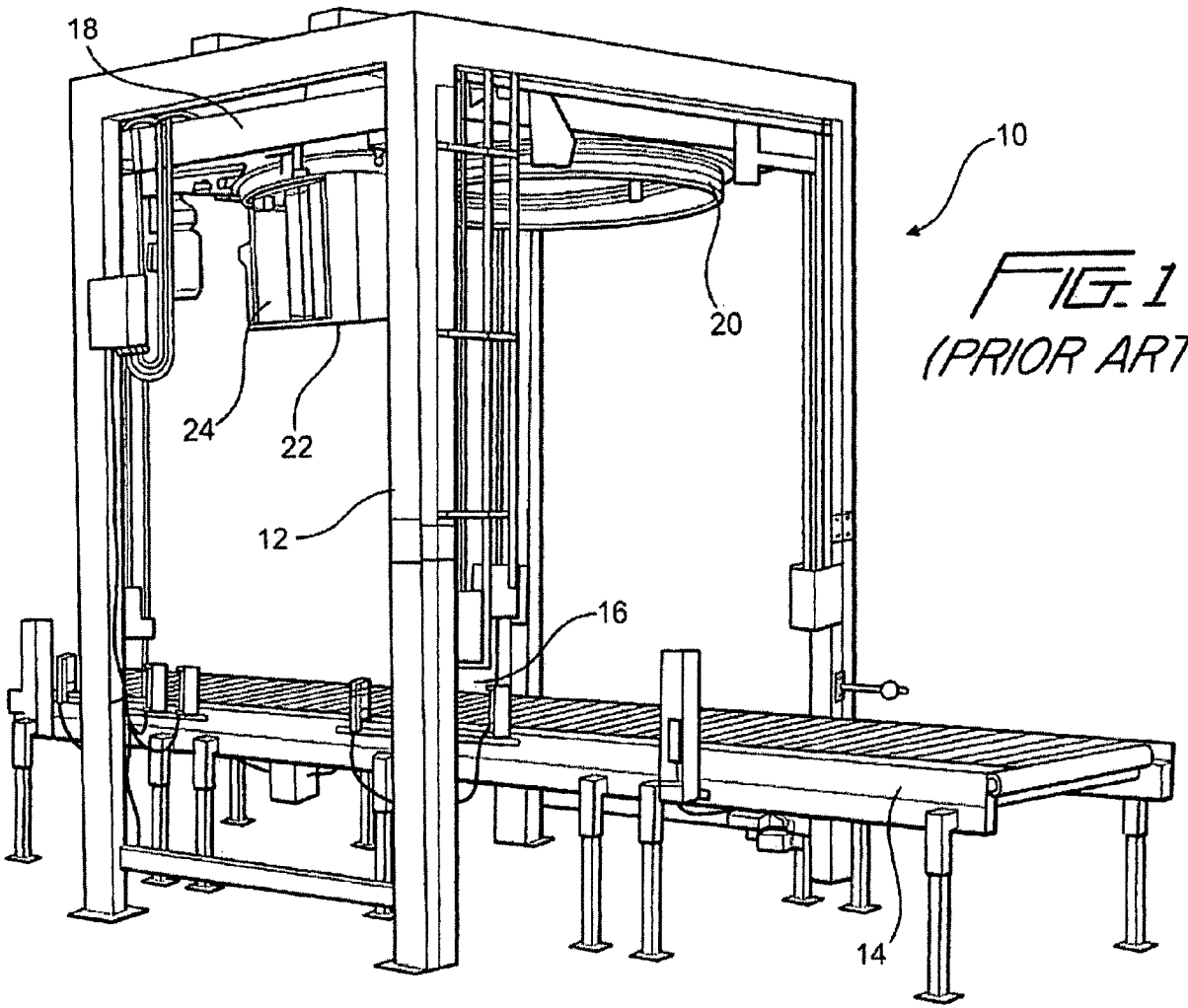
FIG. 1 (PRIOR ART)
FIG. 1 is a perspective view of a conventional, PRIOR ART film wrapping machine.

Referring now to the drawings, and more particularly to FIGS. 2-5 thereof, a new and improved film wrapping or packaging machine, constructed in accordance with the principles and teachings of the present invention, is disclosed and is generally indicated by the reference character 110. More particularly, the new and improved film wrapping or packaging machine 110 is generally or briefly seen to comprise a fixed, upstanding framework 112 through which extends a conveyor mechanism, which is not shown but which is similar to the conveyor 14 as disclosed within FIG. 1, for conveying articles, packages, or palletized loads, to be wrapped or packaged, in a conveying direction CD to a wrapping or packaging station 116 which is located substantially at the center of the region or area which is peripherally defined by means of the upstanding posts of the fixed upstanding framework 112.

A frame member 118, which is vertically movable in a reciprocating manner with respect to the fixed upstanding framework 112, rotatably supports a ring or circular track member 120, and in accordance with a unique and novel feature or structure characteristic of the present invention, a pair of diametrically opposed wrapping or packaging film roll mounting and dispensing carriage assemblies 122,124, upon which rolls of wrapping or packaging film, not shown, are disposed, are fixedly secured upon the rotary ring member 120. In this manner, the pair of diametrically opposed wrapping or packaging film roll mounting and dispensing carriage assemblies 122,124 will be movable with the rotary ring member 120 so as to move or rotate around the wrapping station 116 in order to package or wrap articles, packages, or palletized loads, disposed at the wrapping station 116, within the wrapping or packaging film which is being dispensed from the pair of diametrically opposed wrapping or packaging film roll mounting and dispensing carriage assemblies 122,124 during the performance of a wrapping or packaging operation.

Figure 2:
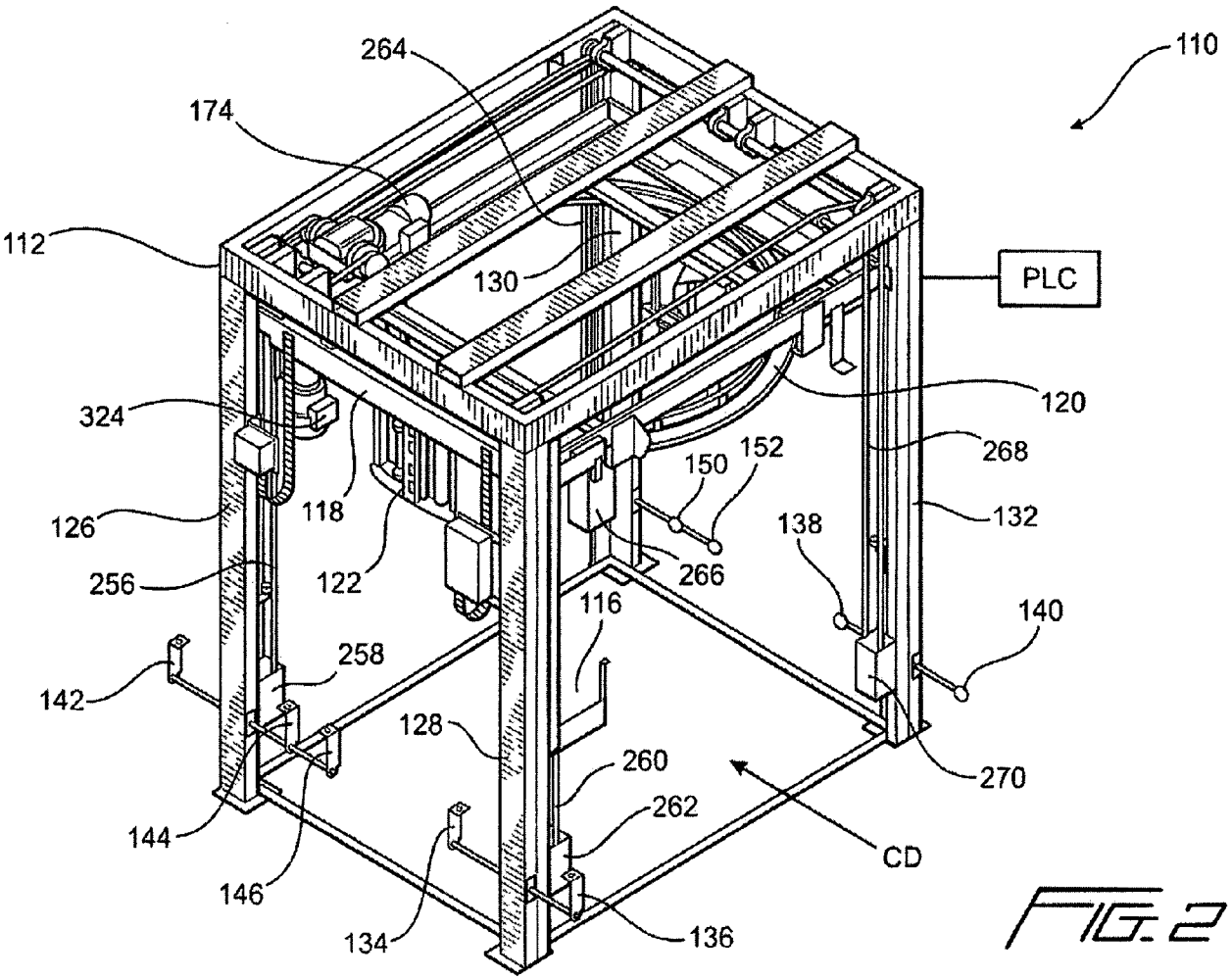
FIG. 2 is a perspective view of a new and improved film wrapping machine as constructed in accordance with the principles and teachings of the present invention and showing the component parts thereof.

Continuing further, and with reference being specifically made to FIG. 2, it is seen that the fixed, upstanding framework 112 comprises four vertically oriented upstanding posts 126, 128,130,132, and that in order to properly control the conveyor mechanism, not shown, for conveying the articles, packages, or palletized loads into and out from the wrapping or packaging station 116, a first pair of phototransmitters 134,136 are mounted upon a lower end portion of the upstanding post 128, while a first pair of photoreflectors 138,140 are mounted upon a lower end portion of the oppositely disposed upstanding post 132 so as to be respectively disposed opposite the phototransmitters 134,136. In a similar manner, three phototransmitters 142,144,146 are mounted upon a lower end portion of the upstanding post 126, while three photoreflectors 148,150,152 are mounted upon a lower end portion of the oppositely disposed upstanding post 130 so as to be respectively disposed opposite the phototransmitters 142, 144. More particularly, it is noted that the cooperative pairs of phototransmitters and photoreflectors 136, 140 and 142,148 comprise safety sensor mechanisms so as to ensure that operator personnel are not within undesirable perimeter areas of the film wrapping or packaging machine 110 which are located adjacent to, for example, the conveyor mechanism, not shown, conveying the articles, packages, or palletized loads toward the wrapping or packaging station 116. Alternatively, for example, another article, package, or palletized load, other than the particular article, package, or palletized load disposed upon the conveyor and being conveyed toward the wrapping or packaging station 116, may be disposed within such perimeter areas of the film wrapping or packaging machine 110 so as to present a potential hazard to the operation of the film wrapping or packaging machine 110.

In either one of these instances, a signal would be sent to a programmable logic controller PLC, which is schematically illustrated and which controls all movements of all of the components of the film wrapping or packaging machine 110, so as to temporarily terminate operation of the film wrapping or packaging machine 110 until the aforenoted potentially hazardous situation or condition is corrected or satisfactorily resolved. Still yet further, the cooperative pair of phototransmitter and photoreflector 134,138 comprise a first article, package, or palletized load sensor mechanism or system whereby the forward, leading, or downstream end portion of the article, package, or palletized load, disposed upon the conveyor mechanism, not shown, will be sensed as the article, package, or palletized load is being conveyed toward the wrapping or packaging station 116, and wherein further, the first article, package, or palletized load sensor mechanism or system, comprising the cooperative pair of phototransmitter and photoreflector components 134,138, will therefore transmit a signal to the programmable logic controller PLC that a film wrapping or packaging operation is about to be commenced. In a similar manner, the cooperative pair of phototransmitter and photoreflector 146,152 comprise a second article, package, or palletized load sensor mechanism or system whereby the forward, leading, or downstream end portion of the article, package, or palletized load, disposed upon the conveyor, not shown, will again be sensed as the article, package, or palletized load is being conveyed into and within the wrapping or packaging station 116, and wherein further, the second article, package, or palletized load sensor mechanism or system comprising the cooperative pair of phototransmitter and photoreflector components 146,152 will therefore transmit a signal to the programmable logic controller PLC to the effect that the activation of the conveyor mechanism, not shown, should be terminated so as to effectively locate the article, package, or palletized load at a substantially central portion within the wrapping or packaging station 116 in order to properly perform a film wrapping or packaging operation.

Lastly, the cooperative pair of phototransmitter and photoreflector 144,150 comprise, in effect, a third, failsafe article, package, or palletized load sensor mechanism or system. Accordingly, if the forward, leading, or downstream end portion of the article, package, or palletized load, disposed upon the conveyor, not shown, is sensed by means of the third article, package, or palletized load sensor mechanism or system comprising the cooperative pair of phototransmitter and photoreflector components 144,150, such as, for example, if the second article, package, or palletized load sensor mechanism or system comprising the cooperative pair of phototransmitter and photoreflector components 146, 152 experiences a failure, or alternatively, if the article, package, or palletized load, disposed upon the conveyor, should experience slippage relative to the conveyor when the movement of the conveyor is terminated, then the third article, package, or palletized load sensor mechanism or system comprising the cooperative pair of phototransmitter and photoreflector components 144,148 will transmit a signal to the programmable logic controller PLC to the effect that not only should the activation of the conveyor mechanism, not shown, be terminated, but in addition, that the entire film wrapping or packaging machine 110 should effectively be temporarily shut down so as to not to commence a faulty film wrapping or packaging operation in connection with the article, package, or palletized load which is not properly located at the wrapping station 116.

This is similarly the case with the first article, package, or palletized load sensor mechanism or system comprising the cooperative pair of phototransmitter and photoreflector components 134,138. More particularly, the first article, package, or palletized load sensor mechanism or system comprising the cooperative pair of phototransmitter and photoreflector components 134,138 also acts or serves as a failsafe mechanism in that when the particular article, package, or palletized load has been conveyed toward the wrapping or packaging station 116, the rear, trailing, or upstream end portion of the article, package, or palletized load must likewise clear the first article, package, or palletized load sensor mechanism or system comprising the cooperative pair of phototransmitter and photoreflector components 134,138 so as to effectively ensure that a properly sized article, package, or palletized load is in fact located, and properly positioned, at the wrapping or packaging station 116 so as to in fact be readied for undergoing a film wrapping or packaging operation.

As can also be best appreciated from FIG. 2, each one of the four vertically upstanding posts 126,128,130,132 comprising the fixed, upstanding framework 112 is noted as comprising, in effect, an angle iron structure having a substantially L-shaped cross-sectional configuration such that inner surface portions of each one of the substantially L-shaped vertically upstanding posts 126,128,130,132 are effectively disposed at 90°, or perpendicular, with respect to each other. In addition, and in connection with such inner surface portions of the plurality of vertically upstanding posts 126,128,130, 132 disposed perpendicular with respect to each other, each one of the external corner regions 154,156, 158,160 of the vertically movable frame member 118, which has a substantially square shaped configuration, has a pair of wheels, the axes of which are also correspondingly disposed at 90° or perpendicular with respect to each other, rotatably mounted upon such external corner region 154,156,158,160 of the vertically movable frame member 118.

Figure 5:
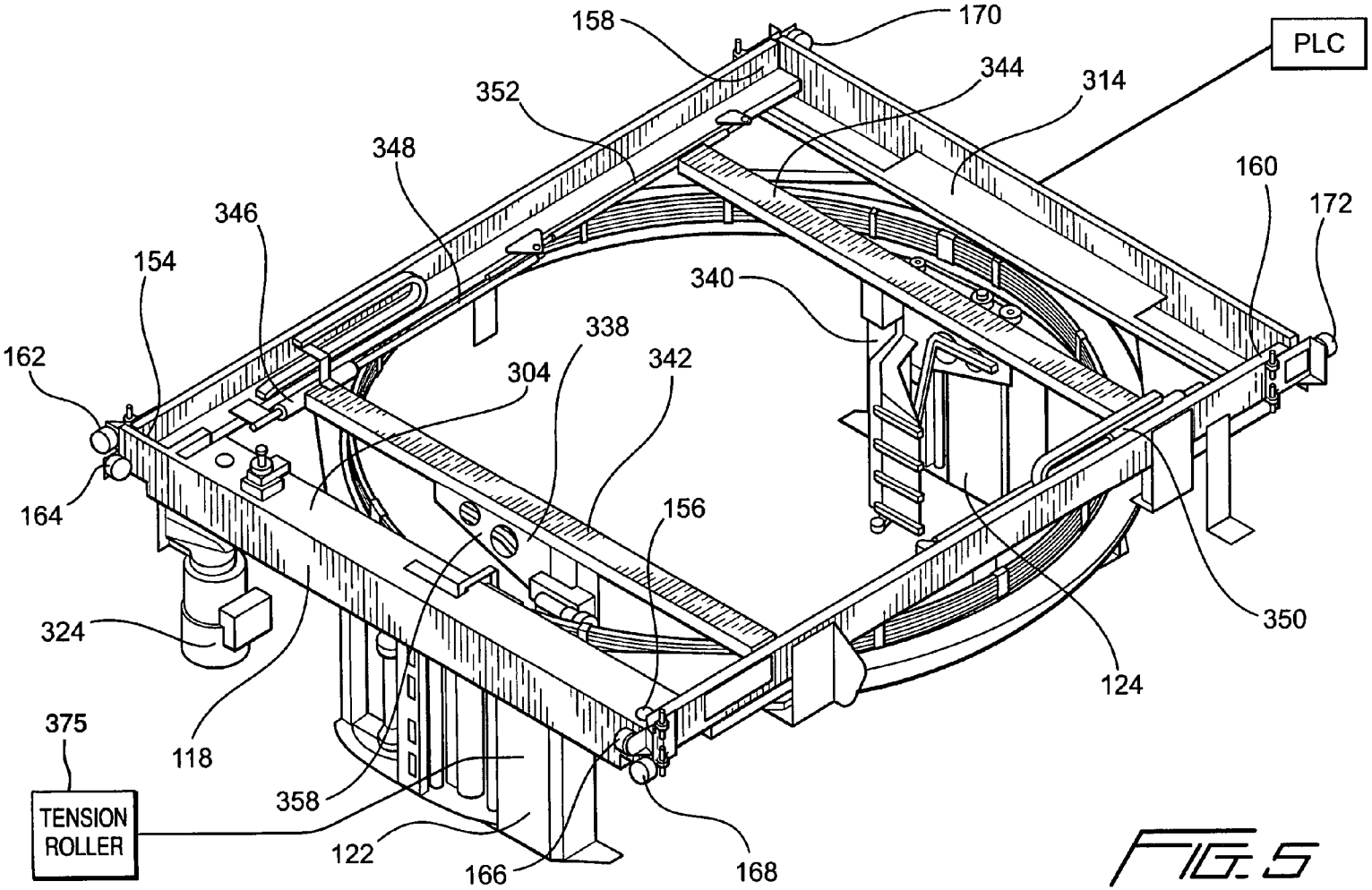
FIG. 5 is a perspective view of the vertically movable frame member, and the rotary ring member and the pair of diametrically opposed film roll mounting and dispensing carriage assemblies mounted thereon.
Figure 6:
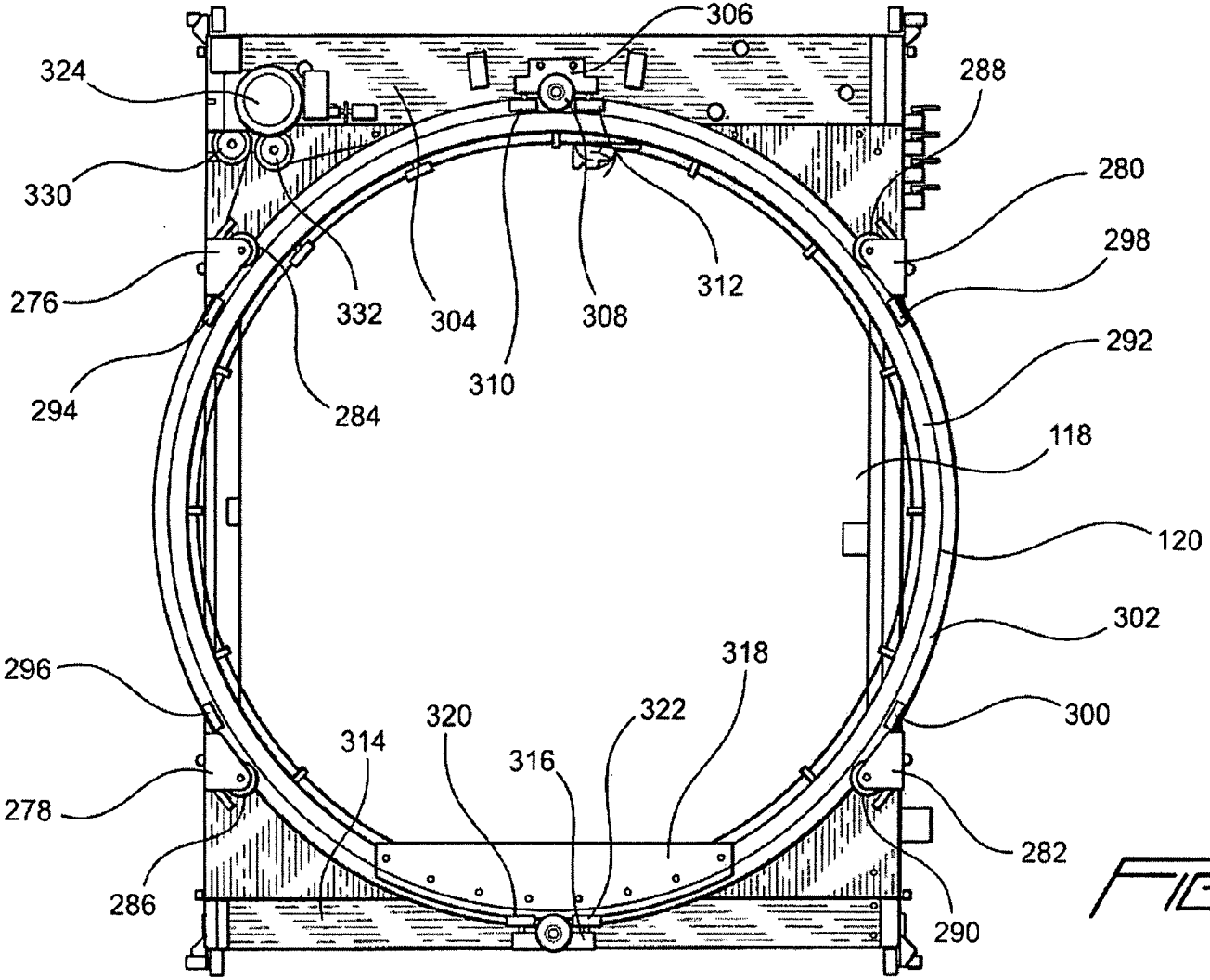
FIG. 6 is a bottom plan view of the rotary ring member as mounted upon the vertically reciprocable frame member by means of the various mounting bracket and wheel assemblies for not only supporting the rotary ring member as mounted upon the vertically reciprocable frame member, but in addition, for rotatably guiding the rotary movement of the rotary ring member with respect to the vertically reciprocable frame member.
Figure 7:
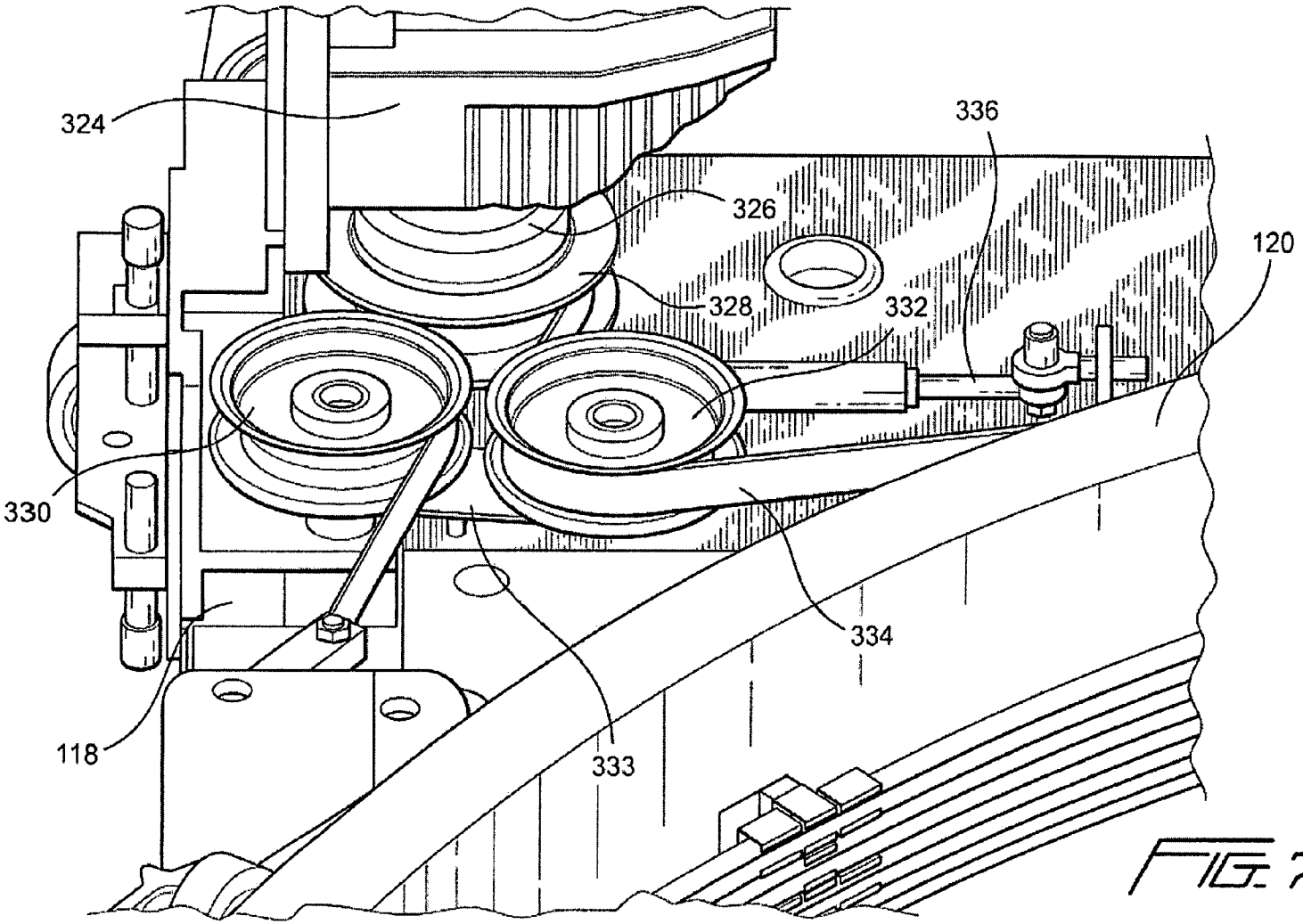
FIG. 7 is a partial, enlarged, perspective view of the undersurface portion of the vertically reciprocable frame member, as illustrated within FIG. 6, showing the drive motor, the idler rollers, and the drive belt utilized for driving the rotary ring member with respect to the vertically reciprocable frame member.
Figure 8:
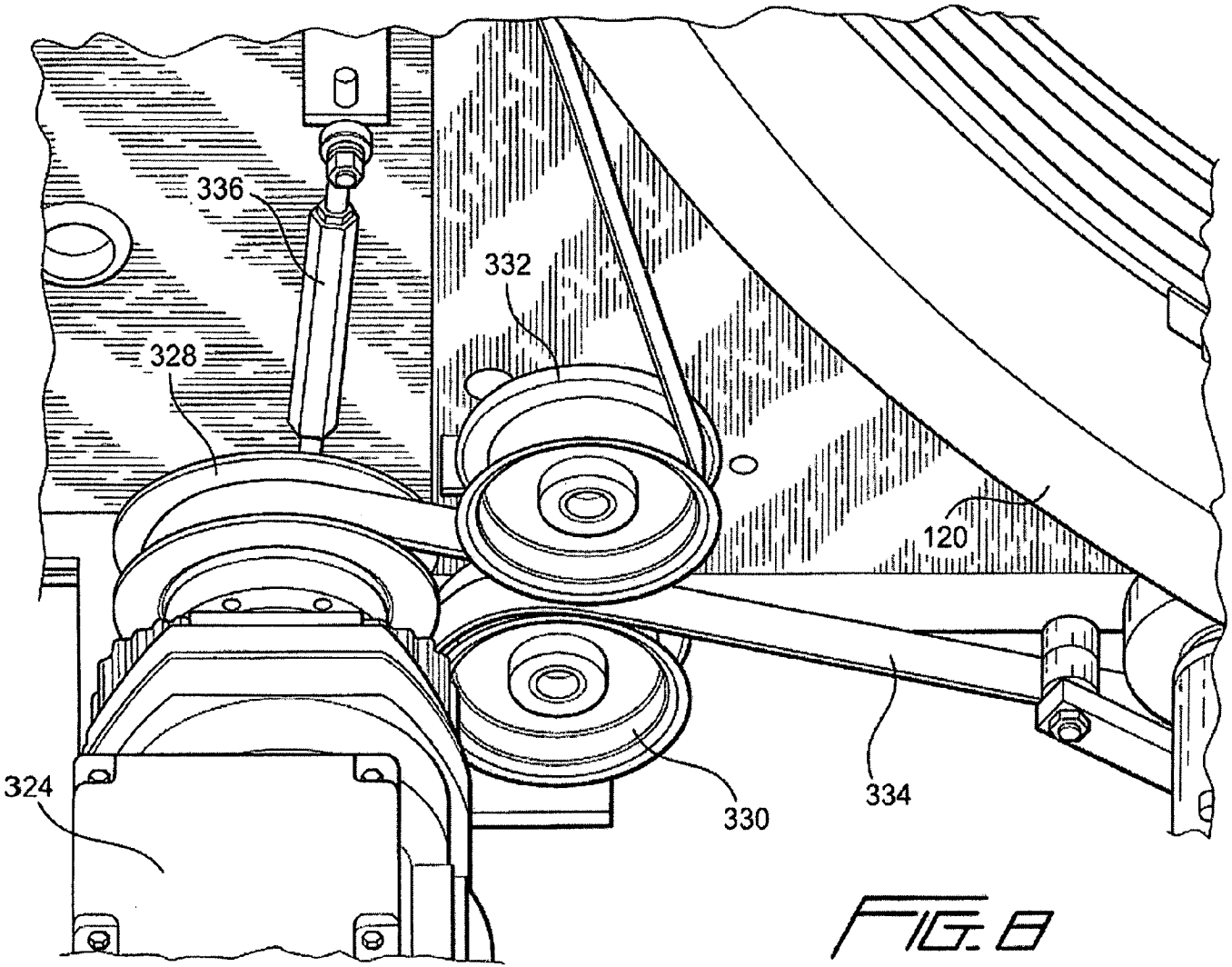
FIG. 8 is a partial, enlarged perspective view, similar to that of FIG. 7, showing, however, the various motor drive components from a different perspective point of view.

More particularly, as can best be seen from FIG. 5, a first pair of wheels 162,164 are rotatably mounted upon suitable mounting bracket structure fixedly mounted upon the external corner region 154 of the vertically movable frame member 118, while a second pair of wheels 166,168 are rotatably mounted upon suitable mounting bracket structure fixedly mounted upon the external corner region 156 of the vertically movable frame member 118. In a similar manner, a third pair of wheels, only one of which is visible at 170, are rotatably mounted upon suitable mounting bracket structure fixedly mounted upon the external corner region 158 of the vertically movable frame member 118, while a fourth pair of wheels, only one of which is visible at 172, are rotatably mounted upon suitable mounting bracket structure fixedly mounted upon the external corner region 160 of the vertically movable frame member 118. In this manner, the vertically movable frame member 118 is in fact able to be smoothly moved along the interior, vertically oriented surfaces of the substantially L-shaped, vertically upstanding posts 126,128,130,132, in vertically upward and downward directions, in accordance with particular cyclically staged movements occurring during the performance of a particular article, package, or palletized load wrapping or packaging operation.

Figure 4:
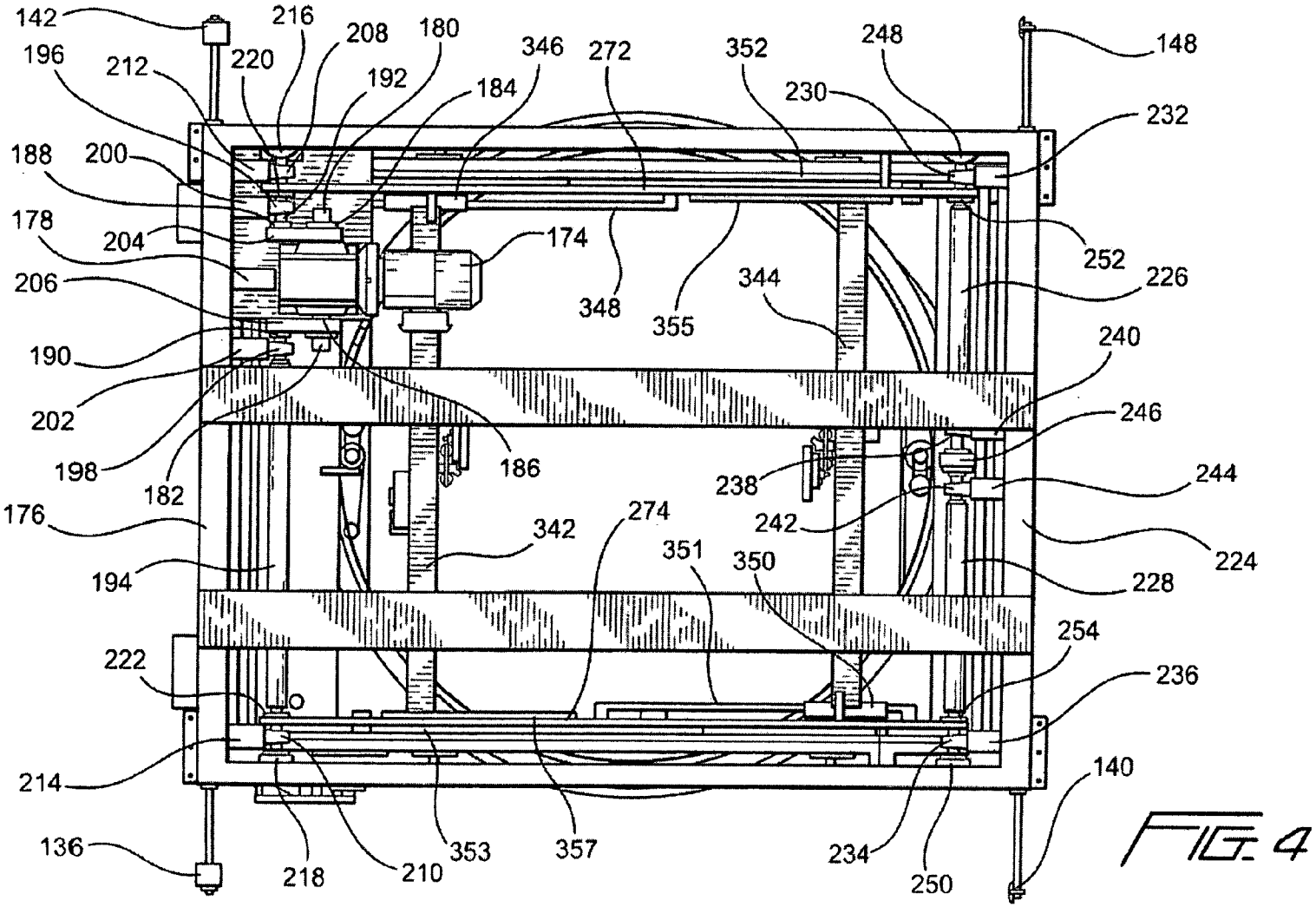
FIG. 4 is a top plan view of the new and improved film wrapping machine, as disclosed within FIGS. 2 and 3, showing the motor drive system for the vertically movable frame member upon which the rotary ring member, and the pair of diametrically opposed film roll mounting and dispensing carriage assemblies, are mounted.

Continuing further, in order to drive or move the vertically movable frame member 118 between its uppermost and lowermost positions during a film wrapping or packaging operation, a first reversible drive motor 174 is fixedly mounted upon a first upper end frame member 176 of the fixed, upstanding framework 112 by means of a suitable mounting plate, mounting bracket, or mounting block 178 which is fixedly or integrally secured to the first upper end frame member 176 of the fixed, upstanding framework 112 as can best be seen in FIG. 4. In addition, it is also seen that the first reversible drive motor 174 is provided with first and second oppositely oriented output drive shafts 180,182 upon which there is respectively disposed first and second output drive sprockets 184,186. First and second output driven sprockets 188,190 are respectively fixedly mounted upon first end portions of the first and second driven shafts 192,194, and it is seen that the first and second driven shafts 192,194 are respectively rotatably mounted within first and second bearing members 196,198 which are, in turn, respectively mounted upon first and second bearing blocks or bearing brackets 200, 202 that are also fixedly mounted upon the first upper end frame member 176 of the fixed, upstanding framework 112. The first and second output drive sprockets 184,186, respectively disposed upon the first and second oppositely oriented output drive shafts 180,182 of the reversible drive motor 174, are respectively operatively connected to the first and second output driven sprockets 188,190, respectively disposed upon first end portions of the first and second driven shafts 192, 194, by means of first and second endless drive sprocket chains 204,206, and it is further seen that the oppositely disposed second end portions of the first and second driven shafts 192,194 are respectively rotatably mounted within third and fourth bearing members 208,210 which are, in turn, respectively mounted upon third and fourth bearing blocks or bearing brackets 212,214 which are also fixedly mounted upon the first upper end frame member 176.

Still yet further, it is also seen that the distal or free end portions of the first and second driven shafts 192,194 are respectively provided with third and fourth output driven sprockets 216,218, while axially inboard regions of the first and second driven shafts 192,194, disposed upon the opposite side of, and adjacent to, the third and fourth bearing members 208,210, are respectively provided with fifth and sixth output driven sprockets 220,222. Upon the opposite side of the overall fixed, upstanding framework 112, and in particular, upon a second upper end frame member 224 of the fixed, upstanding framework 112, which is disposed opposite the first upper end frame member 176 of the fixed, upstanding framework 112, third and fourth driven shafts 226,228 are adapted to be rotatably mounted. More particularly, it is seen that the axially outboard end portion of the third driven shaft 226 is rotatably mounted within a fifth bearing member 230 which is mounted upon a fifth bearing block or bearing bracket 232 that is fixedly mounted upon the second upper end frame member 224, and in a similar manner, the axially outboard end portion of the fourth driven shaft 228 is rotatably mounted within a sixth bearing member 234 which is mounted upon a sixth bearing block or bearing bracket 236 that is likewise fixedly mounted upon the second upper end frame member 224. Still further, it is also seen that the axially inboard end portion of the third driven shaft 226 is rotatably mounted within a seventh bearing member 238 which is mounted upon a seventh bearing block or bearing bracket 240 that is also fixedly mounted upon the second upper end frame member 224, and in a similar manner, the axially inboard end portion of the fourth driven shaft 228 is rotatably mounted within an eighth bearing member 242 which is mounted upon an eighth bearing block or bearing bracket 244 that is likewise fixedly mounted upon the second upper end frame member 224, the axially inboard end portions of the third and fourth driven shafts 226,228 also being operatively connected together by means of a suitable coupling member 246.

Continuing still further, it is additionally seen that seventh and eighth output driven sprockets 248,250 are respectively disposed upon the distal end portions of the third and fourth driven shafts 226,228, and that ninth and tenth output driven sprockets 252,254 are respectively disposed upon the axially inboard sides of the third and fourth driven shafts 226,228 at positions adjacent to the fifth and sixth bearing members 230,234. As can best be seen in FIGS. 2 and 3, and taken in conjunction with FIG. 4, a first vertically oriented endless driven sprocket chain 256, fixedly connected at an intermediate portion thereof to the frame member 118, has its upper end portion disposed around the third output driven sprocket 216 disposed upon the distal end portion of the first driven shaft 192, while the lower end portion of the first endless driven sprocket chain 256 is disposed within a first sprocket chain housing 258 mounted upon a lower end portion of the vertically oriented upstanding post 126 of the fixed upstanding framework 112. In a similar manner, a second vertically oriented endless driven sprocket chain 260, fixedly connected at an intermediate portion thereof to the frame member 118, has its upper end portion disposed around the fourth output driven sprocket 218 disposed upon the distal end portion of the second driven shaft 194, while the lower end portion of the second endless driven sprocket chain 260 is disposed within a second sprocket chain housing 262 mounted upon a lower end portion of the vertically oriented upstanding post 128 of the fixed upstanding framework 112.

Still further, a third vertically oriented endless driven sprocket chain 264, also fixedly connected at an intermediate portion thereof to the frame member 118, has its upper end portion disposed around the seventh output driven sprocket 248 disposed upon the distal end portion of the third driven shaft 226, while the lower end portion of the third endless driven sprocket chain 264 is disposed within a third sprocket chain housing 266 mounted upon a lower end portion of the vertically oriented upstanding post 130 of the fixed upstanding framework 112. Furthermore, a fourth vertically oriented endless driven sprocket chain 268, also fixedly connected at an intermediate portion thereof to the frame member 118, has its upper end portion disposed around the eighth output driven sprocket 250 disposed upon the distal end portion of the fourth driven shaft 228, while the lower end portion of the fourth endless driven sprocket chain 268 is disposed within a fourth sprocket chain housing 270 mounted upon a lower end portion of the vertically oriented upstanding post 132 of the fixed upstanding framework 112. Yet still further, it is also seen that a first horizontally oriented sprocket chain 272 is disposed around the fifth and ninth output driven sprockets 220,252, while a second horizontally oriented sprocket chain 274 is disposed around the sixth and tenth output driven sprockets 222,254. Accordingly, when the first reversible drive motor 174 is actuated so as to, for example, drive the sprocket chains 256,260,264,268 in either direction, that is, to lower or to raise the frame member 118, rotary drive to the vertically oriented sprocket chains 256,260 will be achieved by means of the driven shafts 192,194 and the driven sprockets 216,218, whereas rotary drive to the vertically oriented sprocket chains 264,268 will be achieved by means of the driven shafts 192,194, the driven sprockets 220,222, the horizontally oriented sprocket chains 272,274, the driven sprockets 252,254, the driven shafts 226, 228, and the sprockets 248,250.

With reference now being made to FIGS. 3 and 5-8, the system for mounting the rotary ring member 120 upon the vertically reciprocable frame member 118, as well as the system for rotating the rotary ring member 120 with respect to the vertically reciprocable frame member 118, will now be described. More particularly, as can best be appreciated from FIG. 6, the vertically reciprocable frame member 118 has four substantially triangularly configured mounting brackets or mounting plates 276,278,280,282 fixedly mounted thereon, and each one of the mounting brackets or mounting plates 276, 278,280,282 is respectively provided with a horizontally oriented wheel 284,286,288,290 for engaging a vertically oriented external annular surface portion 292 of the rotary ring member 120. In addition, each one of the mounting brackets or mounting plates 276,278,280,282 is also respectively provided with a vertically oriented wheel 294,296,298, 300 for engaging a horizontally oriented external undersurface portion 302 of the rotary ring member 120 whereby the rotary ring member 120 is in fact supported upon such vertically oriented wheels 294,296,298,300.

Still further, it is also seen that a first side beam member 304 of the frame member 118 is provided with a mounting bracket 306 upon which a fifth horizontally oriented wheel 308 is rotatably mounted so as to be rotatably engaged with the vertically oriented external annular surface portion 292 of the rotary ring member 120, as well as fifth and sixth vertically oriented wheels 310,312 which are rotatably mounted upon the mounting bracket 306 so as to be rotatably engaged with the horizontally oriented external undersurface portion 302 of the rotary ring member 120. In a similar manner, a second oppositely disposed side beam member 314 of the frame member 118 is provided with a mounting bracket 316 upon which a sixth horizontally oriented wheel 318 is rotatably mounted so as to also be rotatably engaged with the vertically oriented external annular surface portion 292 of the rotary ring member 120, as well as seventh and eighth vertically oriented wheels 320,322 which are rotatably mounted upon the mounting bracket 316 so as to be rotatably engaged with the horizontally oriented external undersurface portion 302 of the rotary ring member 120.

As can best be seen in FIG. 5, in order to provide for the relative rotation of the rotary ring member 120, and the pair of diametrically opposed wrapping or packaging film roll mounting and dispensing carriage assemblies 122,124 mounted thereon, with respect to the vertically reciprocable frame member 118, a second, vertically oriented drive motor 324 is fixedly mounted in a dependent manner upon an undersurface portion of the first side beam member 304 of frame member 118 within the vicinity of the triangularly configured mounting bracket 276. In addition, as can best be seen from FIGS. 7 and 8, the output drive shaft 326 of the second, vertically oriented drive motor 324 has an output drive pulley 328 fixedly mounted thereon for rotation with the output drive shaft 326, and a pair of idler or driven pulleys 330, 332 are rotatably mounted upon a substantially L-shaped mounting bracket or mounting plate 333 which is pivotally mounted upon the frame member 118 about an axis which effectively coincides with the axis of the idler or driven pulley 330. In addition, an endless pulley drive belt 334 is disposed around the motor drive pulley 328, routed around an external circumferential portion of the idler or driven pulley 332, routed around the external peripheral portion of the rotary ring member 120, routed back around an external circumferential portion of the idler or driven pulley 330, and routed back around the motor drive pulley 328. It is lastly noted that a turnbuckle mechanism 336 is operatively connected to the substantially L-shaped mounting bracket or mounting plate 333, through means of a crank mechanism, not shown, whereby rotation of the turnbuckle mechanism 336 can pivotally adjust the relative disposition of the substantially L-shaped mounting bracket or mounting plate 333 and the idler or driven pulley 332 with respect to, for example, the motor drive pulley 328 and the idler or driven pulley 330. In this manner, a predetermined amount of tension can be impressed upon or imparted to the endless pulley belt 334 disposed around the external peripheral portion of the rotary ring member 120.

Figure 3:
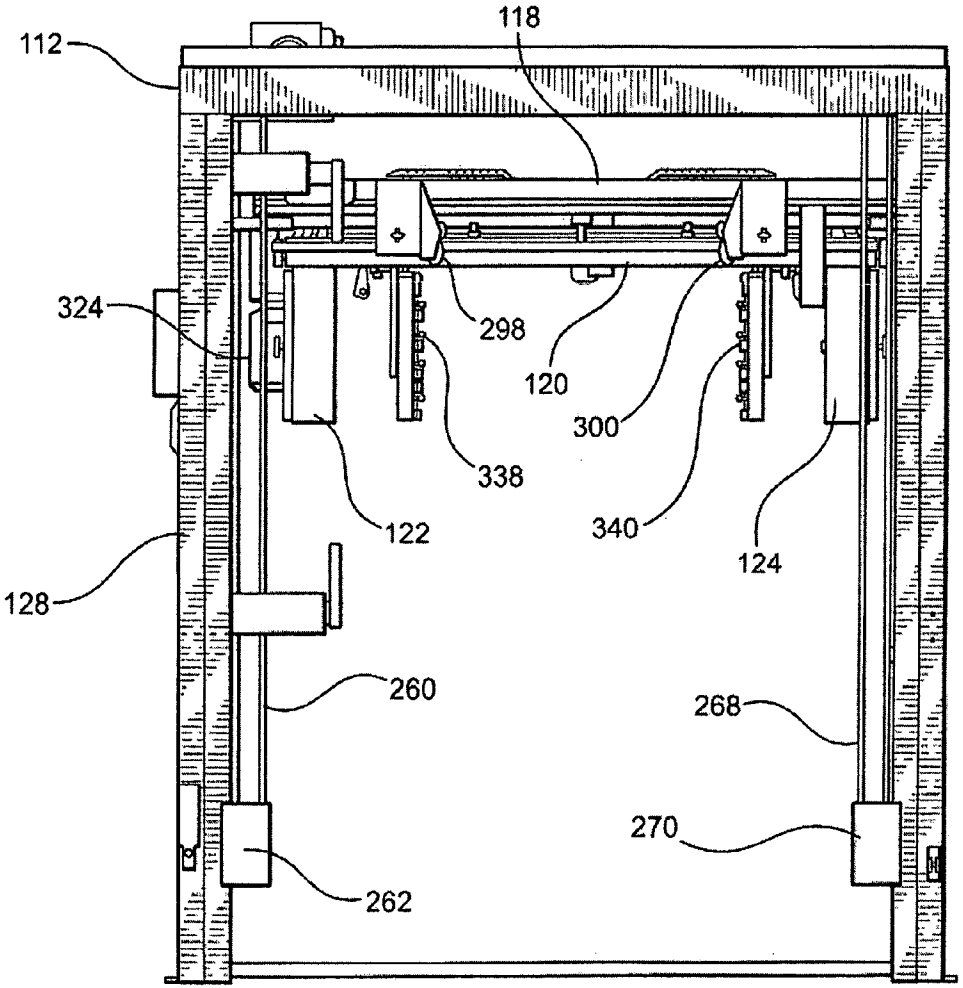
FIG. 3 is a side elevational view of the new and improved film wrapping machine, as disclosed within FIG. 2, showing the pair of diametrically opposed film roll mounting and dispensing carriage assemblies mounted upon the rotary ring member, and the pair of film clamp assemblies mounted upon oppositely disposed, longitudinally extending beam members which are movable in transverse directions toward and away from each other so as to move the pair of film clamp assemblies between their START and FINISH positions during a film wrapping or packaging cycle operation.

With reference now being made to FIGS. 3 and 5, it is seen that a pair of diametrically opposed wrapping or packaging film clamping assemblies 338,340, which are adapted to be operatively associated with the pair of diametrically opposed wrapping or packaging film roll mounting and dispensing carriage assemblies 122,124, as will become more apparent hereinafter, are respectively fixedly mounted in a dependent manner upon a pair of cross-beam members 342,344. As can best be seen in FIGS. 4 and 5, the upper or left end portion of the cross-beam member 342, as viewed in FIGS. 4 and 5, is fixedly connected, such as, for example, by means of a suitable welding process, to a linear bearing housing member 346 containing a linear bearing member, not shown, and the linear bearing member, not shown, is operatively engaged with, or effectively rides upon, a rail or track member 348 so as to effectively be capable of linear translational movement along the same. In a similar manner, the right or lower end portion of the cross-beam member 344, as viewed in FIGS. 4 and 5, is fixedly connected to a linear bearing housing member 350 which likewise contains a linear bearing member, not shown, which is operatively engaged with a rail or track member 351, which can best be seen in FIG. 4, so as to likewise effectively be capable of linear translational movement therealong. A piston-cylinder assembly 352 is fixedly mounted upon the frame member 118 such that the free or distal end portion of the piston rod of the piston-cylinder assembly 352 is operatively connected to the linear bearing housing member 346, and in a similar manner, another piston-cylinder assembly 353, also best seen in FIG. 4, is fixedly mounted upon the frame member 118 such that the free or distal end portion of the piston rod of the piston-cylinder assembly 353 is operatively connected to the linear bearing housing member 350.

The upper or left end portion of the cross-beam member 344, as viewed in FIGS. 4 and 5, is movably mounted upon a track, or within a channel 355, as can best be seen in FIG. 4, which is disposed upon the frame member 118 beneath the piston-cylinder assembly 352, while in a similar manner, the lower or right end portion of the cross-beam member 342, as viewed in FIGS. 4 and 5, is likewise movably mounted upon a track, or within a channel 357, as best seen in FIG. 4, which is disposed upon the frame member 118 beneath the piston-cylinder assembly 353 operatively connected to the linear bearing housing member 350. In this manner, when the piston rods of the piston-cylinder assemblies 352,353 are extended or retracted either independently or in unison, the cross-beam members 342,344, having the wrapping or packaging film clamping assemblies 338,340 disposed thereon, will be respectively moved toward and away from the side beam members 304,314 so as to respectively position the wrapping or packaging film clamping assemblies 338,340 away from or adjacent to the pair of diametrically opposed wrapping or packaging film roll mounting and dispensing carriage assemblies 122, 124. The wrapping or packaging film clamping assemblies 338, 340 are substantially identical with respect to each other, and it is noted that they are disposed upon their respective cross-beam members 342,344 in the same orientations so as to be capable of operation at their diametrically opposed positions with respect to their respective wrapping or packaging film roll mounting and dispensing carriage assemblies 122, 124.

Figure 3A:
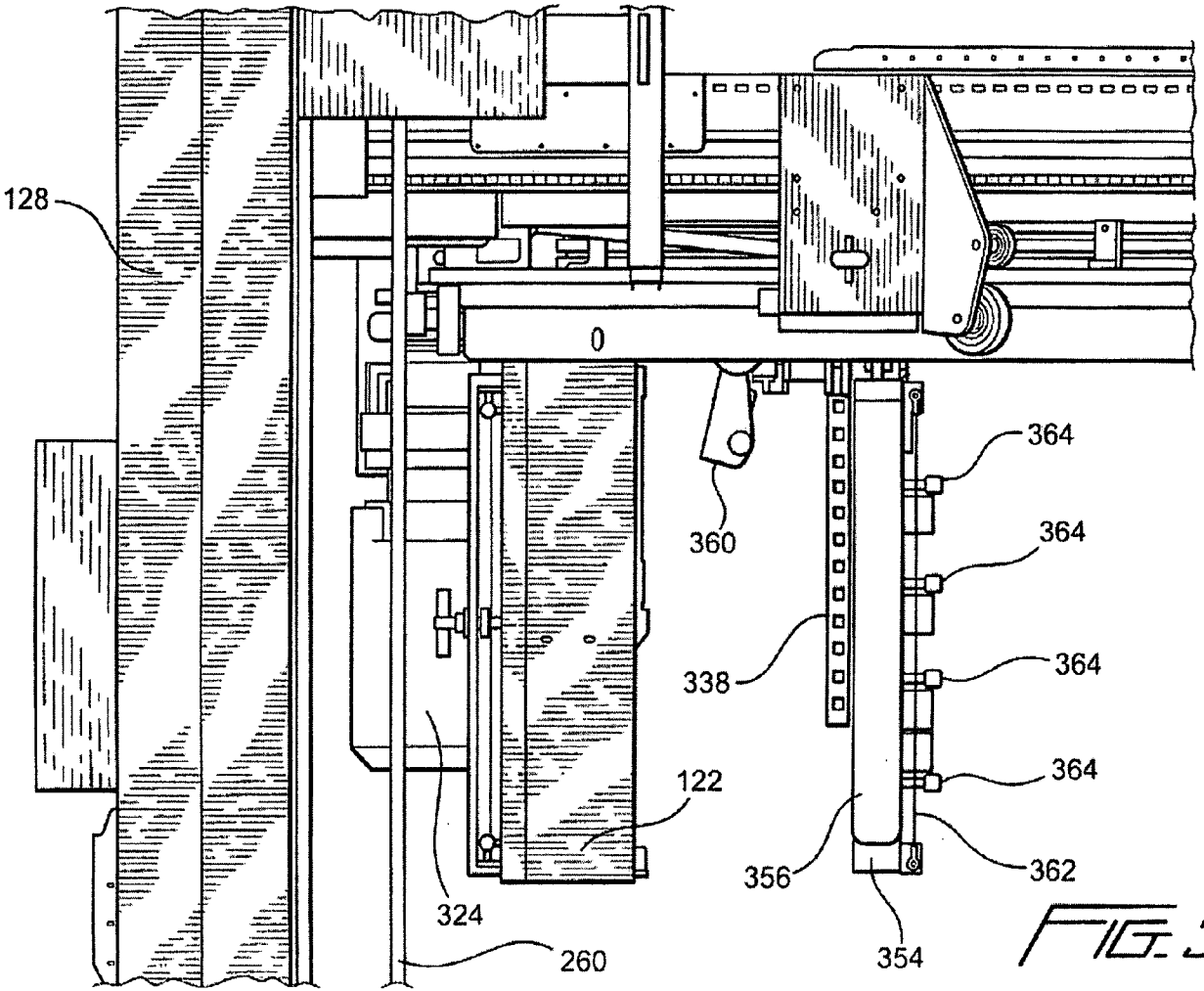
FIG. 3*a* is a partial, enlarged view of FIG. 3 showing the left wrapping or packaging film roll mounting and dispensing carriage assembly, the details of the left wrapping or packaging film clamping assembly, and an auxiliary film clamp mechanism which is adapted to transfer the leading end portion of the wrapping or packaging film between the film tail holder of the wrapping or packaging film roll mounting and dispensing carriage assembly and the wrapping or packaging film clamping assembly.

In connection with the structural composition of each one of the wrapping or packaging film clamping assemblies 338, 340, and with wrapping or packaging film clamping assembly 338 being exemplary as can best be appreciated from FIGS. 3 and 3*a*, it is seen that the wrapping or packaging film clamping assembly 338 comprises a vertically oriented, semi-cylindrical hollow tubular member 354, and a vertically oriented cylindrically configured clamping rod 356. The entire film clamping assembly 338 is pivotally mounted upon a mounting bracket 358, as best seen in FIG. 5, so as to be movable between a first inoperative position, to which the film clamping assembly 338 will have been moved away from the observer or further into the page as viewed in FIG. 3*a*, and a second operative position at which the film clamping assembly 338 will be disposed at its illustrated position within FIG.

3*a*. The upper end portion of the vertically oriented cylindrically configured clamping rod 356 is also pivotally mounted upon the mounting bracket 358 so as to effectively be movable, by means of suitable mechanisms not shown, with respect to the semi-cylindrical tubular member 354 between an OPEN film insertion position, wherein the vertically oriented cylindrically configured clamping rod 356 is effectively disposed out of the page as illustrated within FIG. 3*a*, and a CLOSED film clamping position as illustrated in FIG. 3*a*.

In addition, an auxiliary film clamping mechanism 360 is pivotally mounted upon the mounting bracket 358 for effectively transferring the leading end or film tail portion of the wrapping or packaging film, disposed upon the wrapping or packaging film roll mounting and dispensing carriage assembly 122, from a film tail holder, not shown but disclosed within copending patent application entitled AUTOMATIC FILM CHANGER FOR A FILM WRAPPING MACHINE, Ser. No. 11/723,220, which is hereby incorporated by reference, of the wrapping or packaging film roll mounting and dispensing carriage assembly 122 to a position at which the package wrapping or packaging operation can be commenced after a new or fresh roll of wrapping or packaging film is mounted upon the wrapping or packaging film roll mounting and dispensing carriage assembly 122, all as more fully set forth within the aforenoted co-pending patent application entitled AUTOMATIC FILM CHANGER FOR A FILM WRAPPING MACHINE, Ser. No. 11/723,220. Still further, a film cutting device, in the form of a heated wire 362, is also mounted upon the wrapping or packaging film clamping assembly 338, at a position adjacent to the film clamping tubular member 354 and clamping rod 356, so as to effectively sever the wrapping or packaging film upon completion of a package wrapping or packaging cycle, and still yet further, a plurality of vertically spaced heated sealers 364 are provided for sealing the severed trailing end portion of the wrapping or packaging film onto the wrapped or packaged load.

Having described all of the pertinent structural components of the new and improved film wrapping or packaging machine 110 constructed in accordance with the principles and teachings of the present invention, a brief description of the operation of the same will now be set forth. More particularly, assuming that a package, to be wrapped or packaged within wrapping or packaging film, is already disposed at the wrapping or packaging station 116, the pair of diametrically opposed wrapping or packaging film roll mounting and dispensing carriage assemblies 122,124 are disposed at their START positions, as illustrated within FIG. 5, however, only one of the pair of diametrically opposed wrapping or packaging film roll mounting and dispensing carriage assemblies 122, 124, such as, for example, wrapping or packaging film roll mounting and dispensing carriage assembly 122, will actually begin or commence a package wrapping or packaging cycle, that is, during a package wrapping or packaging cycle or operation, wrapping or packaging film will only be dispensed from wrapping or packaging film roll mounting and dispensing carriage assembly 122. It is of course to be appreciated that the wrapping or packaging film can alternatively be dispensed only from wrapping or packaging film roll mounting and dispensing carriage assembly 124, however, for the purposes of the present description, it will be assumed that film will be dispensed only from wrapping or packaging film roll mounting and dispensing carriage assembly 122.

Accordingly, it is to be noted that at this point in time, while both of the wrapping or packaging film roll mounting and dispensing carriage assemblies 122,124 have been provided with new or fresh rolls of wrapping or packaging film, wherein the free, leading end or film tail portions of the new or fresh rolls of wrapping or packaging film are disposed within the film tail holders, not shown but disclosed within the aforenoted copending patent application entitled AUTOMATIC FILM CHANGER FOR A FILM WRAP-PING MACHINE, Ser. No. 11/723,220, the programmable logic controller PLC will only activate the auxiliary film clamp mechanism 360, operatively associated with the wrapping or packaging film roll mounting and dispensing carriage assembly 122 from which the wrapping or packaging film is to be dispensed, so as to effectively grasp and move the leading end or film tail portion, of the new or fresh roll of wrapping or packaging film disposed upon the wrapping or packaging film roll mounting and dispensing carriage assembly 122 from which the wrapping or packaging film is to be dispensed, from its disposition within the film tail holder to a position at which the film wrapping or packaging operation can be commenced.

Alternatively, after wrapping or packaging film roll mounting and dispensing carriage assembly 122 has completed a previous package wrapping or packaging cycle or operation, the free end portion of the film, disposed upon the roll of wrapping or packaging film disposed within wrapping or packaging film roll mounting and dispensing carriage assembly 122, will be disposed within the corresponding wrapping or packaging film clamping assembly 338, that is, secured between the clamping rod 356 and the semi-cylindrical film clamping tubular member 354.

Subsequently, the programmable logic controller PLC initiates operation of the second, vertically oriented drive motor 324 so as to cause rotation of the rotary ring member 120, and the pair of diametrically opposed wrapping or packaging film roll mounting and dispensing carriage assemblies 122,124 disposed thereon, in the counterclockwise direction, and in addition, and at substantially the same time, the programmable logic controller PLC also initiates operation of the first reversible drive motor 174 so as to drive or move the vertically movable frame member 118, having the rotary ring member 120 rotatably mounted thereon, between its uppermost and lowermost positions during the film wrapping or packaging operation. It is to be noted that, depending upon predetermined or particular wrapping or packaging preferences, operational modes, or the packages or articles to be wrapped or packaged, the vertically movable frame member 118 may initially be disposed at its lowermost position such that the same will ascend during a package wrapping or packaging operation, or alternatively, the vertically movable frame member 118 may initially be disposed at its uppermost position whereby the same will descend during a package wrapping or packaging operation. In either case, at the conclusion of a particular package wrapping or packaging cycle or operation, the programmable logic controller PLC will actuate, for example, piston-cylinder assembly 352, which controls the movement of the cross-beam 342 upon which the wrapping or packaging film clamping assembly 338, operatively associated with the wrapping or packaging film roll mounting and dispensing carriage assembly 122 from which the wrapping or packaging film has been dispensed, is disposed so as to move the wrapping or packaging film clamping assembly 338 to a position adjacent to the film roll mounting and dispensing carriage assembly 122 from which the wrapping or packaging film has been dispensed, wherein it is noted that the wrapping or packaging film roll mounting and dispensing carriage assemblies 122,124 have been stopped at, or effectively returned to, their START positions as illustrated within FIG. 5.

Subsequently, the programmable logic controller PLC will activate the mechanisms, not shown, controlling the pivotal movements of the film clamping tubular member and clamping rod components 354,356 of the wrapping or packaging film clamping mechanism 338 so as to pivotally move the same to their downward positions, and still further, the programmable logic controller PLC will also activate the mechanism, not shown, for controlling the pivotal movement of the clamping rod 356, that is disposed upon the wrapping or packaging film clamping assembly 338, so as to effectively move the clamping rod 356 out of the page, as illustrated within FIG. 3*a*, to its OPEN position with respect to its semi-cylindrical hollow tubular member 354. The programmable logic controller PLC will then activate the second, vertically oriented drive motor 324 so as to again cause rotation of the rotary ring member 120 in the counterclockwise direction so as to move the pair of wrapping or packaging film roll mounting and dispensing carriage assemblies 122,124 to predetermined angular positions just past or beyond the wrapping or packaging film clamping assemblies 338,340. Subsequently still further, the programmable logic controller PLC will again actuate the mechanism, not shown, controlling the pivotal movement of the clamping rod 356 so as to now effectively move the clamping rod 356, back into the page as illustrated in FIG. 3*a*, to its CLOSED position with respect to their semi-cylindrical hollow tubular member 354 so as to effectively clamp a portion of the packaging or wrapping film therebetween, and in addition, the programmable logic controller PLC will again actuate the second, vertically oriented drive motor 324 so as to cause rotation of the rotary ring member 120 in the reverse or clockwise direction so as to effectively move or return the pair of wrapping or packaging film roll mounting and dispensing carriage assemblies 122, 124 back to their START positions. Accordingly, it can be appreciated that the wrapping or packaging film effectively becomes wrapped around the clamping rod 356 of the wrapping or packaging film clamping assembly 338.

Still yet further, at substantially this point in time, the programmable logic controller PLC will also cause the film cutting wires 362 to be heated such that as the clamping rod 356 is moved toward its CLOSED position, a portion of the wrapping or packaging film will be forced into contact with the heated wire 362 thereby severing the wrapping or packaging film. The trailing end portion of the wrapping or packaging film, which forms part of the wrapping or packaging film disposed upon or wrapped around the wrapped or packaged article, package, or palletized load, will then be wiped, pressed, and sealed onto the wrapped or packaged article, package, or palletized load by, for example, the plurality of vertically spaced heated sealers 364, so as to effectively complete the wrapping or packaging operation with respect to the article, package, or palletized load that has just been wrapped or packaged, while the leading end portion of the wrapping or packaging film will be retained within the wrapping or packaging film clamping assembly 338, by means of the tubular cylinder and clamping rod 354,364, in preparation for the commencement or start of a new wrapping or packaging cycle or operation. It is of course to be understood that at the commencement or start of such a new wrapping or packaging cycle or operation, after a predetermined number of wrapping or packaging film layers have been wrapped around the article or object to be wrapped or packaged, the tubular cylinders and clamping rods 354,364 of the film clamping assemblies 338, 340 will release the leading end portions of the wrapping or packaging films.

In accordance with last principles and teachings of the present invention, it is to be noted that if the roll of film, disposed upon wrapping or packaging film roll mounting and dispensing carriage assembly 122, becomes depleted or experiences a breakage during a package wrapping or packaging cycle or operation, such a condition will be sensed, for example, by means of a tension roller which includes, for example, a strain gauge or the like, schematically shown at 375 within FIG. 5 and more fully disclosed within the aforenoted copending patent application entitled AUTOMATIC FILM CHANGER FOR A FILM WRAPPING MACHINE, Ser. No. 11/723,220. Accordingly, several operational options are available at this point in time. In accordance with a first, fully automatic mode of operation, a signal will be sent from the tension roller to the programmable logic controller PLC, and the programmable logic controller PLC will send an appropriate signal to the first reversible drive motor 174 in order to effectively return the vertically movable frame member 118 to its original package wrapping or packaging START position, that is, either to its uppermost or lowermost elevational position depending upon whether or not the article, package, or palletized load is being wrapped or packaged while the vertically movable frame member 118 is moving in an ascending mode or in a descending mode. In addition, the programmable logic controller PLC will also send an appropriate signal to the second reversible drive motor 324 so as to effectively rotate the rotary ring member 120 back to its START position as illustrated, for example, within FIG. 5. Subsequently still further, the programmable logic controller PLC will activate the auxiliary film clamp mechanism 360, operatively associated with the wrapping or packaging film roll mounting and dispensing carriage assembly 124, from which the wrapping or packaging film is to now be dispensed, so as to effectively grasp and move the leading end or film tail portion, of the new or fresh roll of wrapping or packaging film disposed upon the wrapping or packaging film roll mounting and dispensing carriage assembly 124 from which the wrapping or packaging film is to be dispensed, from its disposition within the film tail holder to a position at which the film wrapping or packaging operation can be commenced anew.

It can therefore be appreciated that in accordance with this particular mode of operation, the incompletely wrapped or packaged article, package, or palletized load will now effectively be completely wrapped by means of the packaging or wrapping film, being dispensed from the wrapping or packaging film roll mounting and dispensing carriage assembly 124, as a result of the film, dispensed from the wrapping or packaging film roll mounting and dispensing carriage assembly 124, being wrapped directly over the previously incomplete wrapping or packaging film. In this manner, despite the occurrence of the depletion or breakage of the packaging or wrapping film upon the wrapping or packaging film roll mounting and dispensing carriage assembly 122, the package wrapping or packaging cycles or operations can automatically continue until the wrapping or packaging film, now being dispensed from the wrapping or packaging film roll mounting and dispensing carriage assembly 124, is fully depleted. At such point in time, both depleted rolls of wrapping or packaging film can be replaced with new or fresh rolls of wrapping or packaging film, or alternatively, the second depleted roll of wrapping or packaging film can be replaced with a new or fresh roll of wrapping or packaging film, while the original roll of wrapping or packaging film, which experienced the breakage in the film, can effectively have its leading end or film tail portion reinserted within the film tail holder operatively associated with the wrapping or packaging film clamping assembly 338 disposed upon the wrapping or packaging film roll mounting and dispensing carriage assembly 122 so as to permit the film wrapping or packaging machine 110 to begin or commence a new cycle or series of package wrapping or packaging operations similar to the original cycle or series of package wrapping or packaging operations.

In accordance with a second, alternative semi-automatic mode of operation, as has been noted hereinbefore, when the roll of film, disposed upon wrapping or packaging film roll mounting and dispensing carriage assembly 122, becomes depleted or experiences a breakage during a package wrapping or packaging cycle or operation, such a condition will be sensed, for example, by means of the tension roller, and accordingly, a signal will be sent from the tension roller to the programmable logic controller PLC whereby the programmable logic controller PLC will now send an appropriate signal to the first reversible drive motor 174 in order to effectively stop the movement of the vertically movable frame member 118 at its current elevational level. At this point in time, an operator can effectively seal the trailing end portion of the film, disposed upon the incompletely wrapped or packaged article, package, or palletized load, onto that portion of the wrapping or packaging film which is already wrapped upon the incompletely wrapped or packaged article, package, or palletized load, and if the roll of film, disposed upon the wrapping or packaging film roll mounting and dispensing carriage assembly 122, was depleted, the programmable logic controller PLC will activate the auxiliary film clamp mechanism 360, operatively associated with the wrapping or packaging film roll mounting and dispensing carriage assembly 124, from which the wrapping or packaging film is to now be dispensed, so as to effectively grasp and move the leading end or film tail portion, of the new or fresh roll of wrapping or packaging film disposed upon the wrapping or packaging film roll mounting and dispensing carriage assembly 124 from which the wrapping or packaging film is to be dispensed, from its disposition within the film tail holder to a position at which the film wrapping or packaging operation can be commenced.

Alternatively, if the roll of film, disposed upon the wrapping or packaging film roll mounting and dispensing carriage assembly 122, experienced a breakage, the operator can reinsert the leading end or film tail portion of the film, disposed upon the wrapping or packaging film roll mounting and dispensing carriage assembly 122, back into the film tail holder, and subsequently, the programmable logic controller PLC will activate the auxiliary film clamp mechanism 360, operatively associated with the wrapping or packaging film roll mounting and dispensing carriage assembly 122 from which dispensing of the wrapping or packaging film is to be resumed, so as to effectively grasp and move the leading end or film tail portion of the wrapping or packaging film, disposed upon the wrapping or packaging film roll mounting and dispensing carriage assembly 122, from its disposition within the film tail holder to a position at which the film wrapping or packaging operation can be resumed.

It is to be further appreciated that when the wrapping or packaging film, disposed upon the wrapping or packaging film roll mounting and dispensing carriage assembly 122, is finally depleted, the operation of the film wrapping or packaging machine 110 will effectively be temporarily halted at the position at which the film depletion occurred, the operator will seal the trailing end portion of the depleted film onto the incompletely wrapped or packaged article, package, or palletized load, and subsequently, the programmable logic controller PLC will effectively switch over the operation of the film wrapping or packaging machine 110, by actuating the auxiliary film clamp mechanism 360, operatively associated with the wrapping or packaging film roll mounting and dispensing carriage assembly 124, as has been previously described, such that the package wrapping or packaging operations can continue in accordance with this second, semi-automatic mode of operation until, of course, the wrapping or packaging film, disposed upon the wrapping or packaging film roll mounting and dispensing carriage assembly 124, is also depleted, at which time both wrapping or packaging film roll mounting and dispensing carriage assemblies 122,124 need to have new or fresh rolls of wrapping or packaging film placed thereon. It can therefore be appreciated that in accordance with this second, semi-automatic mode of operation, the wrapping or packaging operation is effectively continued at the place where the depletion or the breakage of the wrapping or packaging film occurred without the need for the entire package wrapping or packaging operation to be completely restarted from the beginning of the package wrapping or packaging operation. It is to lastly be noted that in accordance with the aforenoted second, semi-automatic mode of operation, the continued presence of an operator is substantially required in order to effectively monitor the package wrapping or packaging operations, however, the film wrapping or packaging machine 110 may be provided with a suitable alarm circuit by means of which, when a film depletion or breakage occurs, an alarm is sounded thereby effectively summoning an operator. In this manner, the operator's presence is not always required whereby the film wrapping or packaging machine 110 can run automatically without the need for an operator to continuously monitor or oversee the package wrapping or packaging operations.

Thus, it may be seen that in accordance with the principles and teachings of the present invention, there has been disclosed a new and improved film wrapping or packaging machine wherein a pair of diametrically opposed film roll mounting and dispensing carriage assemblies are used to individually, separately, and sequentially dispense their wrapping or packaging films, and wherein further, if depletion or breakage occurs within the wrapping or packaging film being dispensed by means of the first film roll mounting and dispensing carriage assembly, the second film roll mounting and dispensing carriage assembly can effectively be activated so as to dispense its wrapping or packaging film whereby the film wrapping or packaging operation can continue with a minimum amount of stoppage or downtime. The switch-over or change-over between the first and second film roll mounting and dispensing carriage assemblies can be achieved in accordance with automatic and semi-automatic modes of operation.

Obviously, many variations and modifications of the present invention are possible in light of the above teachings. It is therefore to be understood that within the scope of the appended claims, the present invention may be practiced otherwise than as specifically described herein.

What is claimed as new and desired to be protected by Letters Patent of the United States of America, is:

1. A film wrapping machine for wrapping articles within wrapping film, comprising:

an upstanding framework;

a wrapping station, defined within said upstanding framework, at which an article to be wrapped is adapted to be disposed during an article wrapping operation;

a vertically movable frame member mounted upon said upstanding framework;

a first motor drive for moving said vertically movable frame member in a vertically reciprocal manner;

a rotary ring member mounted upon said vertically movable frame member;

a second motor drive for causing said rotary ring member to undergo rotary movement around said wrapping station at which the article to be wrapped is disposed; and a pair of oppositely disposed film roll mounting and dispensing carriage assemblies mounted upon said rotary ring member for individually and sequentially dispensing wrapping film, during a film wrapping operation, such that the article, disposed at said wrapping station in order to be wrapped, can be wrapped within wrapping film;

structure for sensing a lack of tension within a first supply of wrapping film, which is indicative of one of breakage and depletion of the first supply of wrapping film being dispensed from a first one of said pair of oppositely disposed film roll mounting and dispensing carriage assemblies, and for issuing a signal in response to said lack of tension indicating one of breakage and depletion of said first supply of wrapping film being dispensed from a first one of said pair of oppositely disposed film roll mounting and dispensing carriage assemblies;

a control device for activating a second one of said pair of oppositely disposed film roll mounting and dispensing carriage assemblies, in response to said signal of said tension sensing structure in response to said one of breakage and depletion of said first supply of wrapping film being dispensed from said first one of said pair of oppositely disposed film roll mounting and dispensing carriage assemblies, such that if the wrapping film, disposed upon said first one of said pair of oppositely disposed film roll mounting and dispensing carriage assemblies, experiences a condition comprising one of depletion and breakage, said second one of said pair of oppositely disposed film roll mounting and dispensing carriage assemblies can dispense its wrapping film such that said film wrapping operation can be continued; and a pair of auxiliary film clamping mechanisms respectively mounted upon said pair of beam members for removing leading end portions of the wrapping films from said pair of film roll mounting and dispensing assemblies in order to prepare for the commencement of film wrapping operations utilizing new rolls of wrapping film.

2. The film wrapping machine as set forth in claim 1, wherein:

said pair of oppositely disposed film roll mounting and dispensing carriage assemblies are mounted upon said rotary ring member at diametrically opposed positions.

3. The film wrapping machine as set forth in claim 2, further comprising:

a pair of film clamping mechanisms respectively operatively associated with said pair of oppositely disposed film roll mounting and dispensing assemblies for holding leading end portions of the wrapping films in order to commence film wrapping operations after the wrapping films have been severed at the conclusion of a previous film wrapping operation.

4. The film wrapping machine as set forth in claim 3, further comprising:

a pair of beam members upon which said pair of film clamping mechanisms are respectively mounted; and actuators for movably mounting said pair of beam members upon said vertically movable frame member so as to move said pair of beam members, and said pair of film clamping mechanisms mounted thereon, toward and away from said pair of oppositely disposed film roll mounting and dispensing assemblies.

5. The film wrapping machine as set forth in claim 4, wherein:

said actuators for movably mounting said pair of beam members comprises a pair of piston-cylinder assemblies.

6. The film wrapping machine as set forth in claim 3, wherein:

said pair of film clamping mechanisms each comprise a semi-cylindrical hollow tubular member, and a clamping rod member, pivotally movable between OPEN and CLOSED positions, for operatively cooperating with said semi-cylindrical hollow tubular member so as to secure the leading end portion of the wrapping film between said semi-cylindrical tubular member and said clamping rod member when said clamping rod member is disposed at said CLOSED position.

7. The film wrapping machine as set forth in claim 1, wherein:

said control device is also adapted for cyclically controlling the drives and movements of said first motor drive, said second motor drive, said pair of film clamping mechanisms, said piston-cylinder assemblies, and said auxiliary film clamping mechanisms during said film wrapping operation.

8. The film wrapping machine as set forth in claim 7, wherein:

said control device comprises a programmable logic controller (PLC).

9. The film wrapping machine as set claim 1, wherein:

said structure for sensing a lack of tension within the first supply of wrapping film comprises a tension roller.

10. A method of wrapping articles within wrapping film, comprising the steps of:

providing an upstanding framework;

defining a wrapping station within said upstanding framework at which an article to be wrapped is adapted to be disposed during an article wrapping operation;

mounting a vertically movable frame member upon said upstanding framework;

mounting a rotary ring member upon said vertically movable frame member;

mounting a pair of oppositely disposed film roll mounting and dispensing carriage assemblies upon said rotary ring member for individually and sequentially dispensing wrapping film, during a film wrapping operation, such that the article, disposed at said wrapping station in order to be wrapped, can be wrapped within wrapping film;

vertically moving said vertically movable frame member from a START position while rotating said rotary ring member such that a first one of said pair of film roll mounting and dispensing carriage assemblies, mounted upon said rotary ring member, can dispense wrapping film so as to wrap the article, disposed at said wrapping station in order to be wrapped, within wrapping film in accordance with a film wrapping operation;

sensing a condition comprising a lack of tension, within a first supply of wrapping film, as being indicative of one of breakage and depletion of the first supply of wrapping film being dispensed from said first one of said pair of oppositely disposed film roll mounting and dispensing carriage assemblies;

issuing a signal in response to said sensed lack of tension indicative of one of breakage and depletion of said first supply of wrapping film being dispensed from a first one of said pair of oppositely disposed film roll mounting and dispensing carriage assemblies;

terminating dispensing of the wrapping film from said first one of said multiple film roll mounting and dispensing carriage assemblies, mounted upon said rotary ring member, in response to said signal indicating that the wrapping film, disposed upon said first one of said multiple film roll mounting and dispensing carriage assemblies, has experienced a condition comprising one of depletion and breakage during said film wrapping operation;

activating a second one of said pair of film roll mounting and dispensing carriage assemblies, in response to said signal indicating said one of breakage and depletion of said first supply of wrapping film being dispensed from said first one of said pair of oppositely disposed film roll mounting and dispensing carriage assemblies, such that said second one of said multiple film roll mounting and dispensing carriage assemblies can dispense its wrapping film whereby said film wrapping operation can be continued; and respectively mounting a pair of auxiliary film clamping mechanisms upon said pair of beam members for removing leading end portions of the wrapping films from said pair of film roll mounting and dispensing assemblies in order to prepare for the commencement of film wrapping operations utilizing new rolls of wrapping film.

11. The method as set forth in claim 10, further comprising the step of:

said sensing of said lack of tension within the first supply of wrapping film comprises the use of a tension roller disposed within said first one of said pair of oppositely disposed film roll mounting and dispensing carriage assemblies.

12. The method as set forth in claim 10, further comprising the step of:

returning said vertically movable frame member to said START position before activating said second one of said multiple film roll mounting and dispensing carriage assemblies such that the wrapping film, to be dispensed from said second one of said multiple film roll mounting and dispensing carriage assemblies, will be dispensed from said second one of said multiple film roll mounting and dispensing carriage assemblies so as to be wrapped directly over the incompletely wrapped wrapping film, disposed upon the article to be wrapped and disposed at said wrapping station, which was previously dispensed from said one of said multiple film roll mounting and dispensing carriage assemblies.

13. The method as set forth in claim 10, further comprising the steps of:

terminating vertical movement of said vertically movable frame member at the elevational position at which the wrapping film, disposed upon said first one of said multiple film roll mounting and dispensing carriage assemblies, experienced the condition comprising one of depletion and breakage during said film wrapping operation;

sealing a trailing end portion of the wrapping film, which has undergone one of the depletion and breakage conditions, onto the portion of the wrapping film which has been wrapped onto the article; and activating said second one of said multiple film roll mounting and dispensing carriage assemblies such that the wrapping film, to be dispensed from said second one of said multiple film roll mounting and dispensing carriage assemblies, will be dispensed from said second one of said multiple film roll mounting and dispensing carriage assemblies so as to effectively continue said film wrapping operation upon the article being wrapped at the location at which the wrapping film, disposed upon said first one of said multiple film roll mounting and dispensing carriage assemblies, experienced the condition comprising one of depletion and breakage during said film wrapping operation.

14. The method as set forth in claim 10, further comprising the step of:

mounting said pair of film roll mounting and dispensing carriage assemblies at diametrically opposed positions upon said rotary ring member.

15. The method as set forth in claim 14, further comprising the step of:

respectively providing a pair of film clamping mechanisms to be operatively associated with said pair of film roll mounting and dispensing assemblies for holding leading end portions of the wrapping films in order to commence film wrapping operations after the wrapping films have been severed at the conclusion of a previous film wrapping operation.

16. The method as set forth in claim 15, further comprising the steps of:

respectively mounting said pair of film clamping mechanisms upon a pair of beam members; and movably mounting said pair of beam members upon said vertically movable frame member such that said pair of beam members, and said pair of film clamping mechanisms mounted thereon, are movable toward and away from said pair of film roll mounting and dispensing assemblies.

17. The method as set forth in claim 16, further comprising the step of:

utilizing piston-cylinder assemblies, mounted upon said vertically movable frame member, for reciprocally moving said pair of beam members, and said pair of film clamping mechanisms mounted thereon, toward and away from said pair of film roll mounting and dispensing assemblies.

18. The method as set forth in claim 15, further comprising the step of:

using said pair of film clamping mechanisms wherein each comprises a semi-cylindrical hollow tubular member, and a clamping rod member, pivotally movable between OPEN and CLOSED positions, for operatively cooperating with said semi-cylindrical hollow tubular member so as to secure the leading end portion of the wrapping film between said semi-cylindrical tubular member and said clamping rod member when said clamping rod member is disposed at said CLOSED position.

19. The method as set forth in claim 10, further comprising the step of:

cyclically controlling the movements of said vertically movable frame member, said rotary ring member, said pair of film clamping mechanisms, said piston-cylinder assemblies, and said auxiliary film clamping means during said film wrapping operation.

20. The method as set forth in claim 19, further comprising the step of:

utilizing a programmable logic controller (PLC) to cyclically control the movements of said vertically movable frame member, said rotary ring member, said pair of film clamping mechanisms, said piston-cylinder assemblies, and said auxiliary film clamping means during said film wrapping operation.

* * * * *